US007918744B1

(12) United States Patent
Rim

(10) Patent No.: US 7,918,744 B1
(45) Date of Patent: Apr. 5, 2011

(54) REMOVABLE GOLF-BALL ALIGNING DEVICE

(76) Inventor: Chol Kwi Rim, Gardena, CA (US)

( * ) Notice: Subject to any disclaimer, the term of this patent is extended or adjusted under 35 U.S.C. 154(b) by 0 days.

(21) Appl. No.: 12/462,451

(22) Filed: Aug. 4, 2009

(51) Int. Cl.
*A63B 69/36* (2006.01)

(52) U.S. Cl. ..... 473/210; 473/268

(58) Field of Classification Search ..... 473/207, 473/208, 210, 211, 268, 274; D21/791
See application file for complete search history.

(56) References Cited

U.S. PATENT DOCUMENTS

| | | | | |
|---|---|---|---|---|
| 1,459,705 | A | 6/1923 | Bullock | |
| 1,857,284 | A * | 5/1932 | Nelson | 2/10 |
| 3,156,211 | A | 11/1964 | Mallory, Jr. | |
| 3,178,187 | A | 4/1965 | Cardwell | |
| 3,437,339 | A | 4/1969 | Starck | |
| 3,729,199 | A | 4/1973 | Granberg | |
| 3,812,593 | A | 5/1974 | Wydro | |
| 3,826,502 | A | 7/1974 | Sorge | |
| 4,063,740 | A | 12/1977 | Mader | |
| 4,541,125 | A * | 9/1985 | Phillips | 2/10 |
| 4,762,325 | A * | 8/1988 | McCleery | 473/210 |
| 4,896,375 | A | 1/1990 | Colucci | |
| 6,491,390 | B1 * | 12/2002 | Provost | 351/155 |
| 6,672,972 | B1 | 1/2004 | Stone | |
| 6,721,962 | B1 | 4/2004 | Plaire | |

* cited by examiner

*Primary Examiner* — Nini Legesse
(74) *Attorney, Agent, or Firm* — Albert O. Cota

(57) ABSTRACT

A removable golf-ball aligning device (RGAD) (10) that is designed to allow a golfer, especially when putting, to align a golf ball to travel in a straight trajectory. The RGAD (10) is designed to be attached to the bill (186) of a golf cap (182) or a golf visor (184) and is comprised of three major elements: a bill attachment member (12), a panel (30) and a means (46) for attaching the panel (30) to the bill attachment member (12). The panel (30) is made of a transparent material (56) and includes a lower section (36) that terminates with a lower straight edge (32). The lower section is coated with a non-glare coating (60) that can consist of a non-glare paint (62) or a black non-glare tape (64).

10 Claims, 5 Drawing Sheets

REMOVABLE GOLF-BALL ALIGNING DEVICE

TECHNICAL FIELD

The invention generally pertains to golf-ball aligning devices and more particularly to a removable golf-ball aligning device (RGAD) that is designed to be attached to the bill of a golf cap or a golf visor. The RGAD aids a golfer in aligning a straight ball trajectory along a golf course especially when the golfer is putting.

BACKGROUND ART

One of the most popular sports throughout the world is the game of golf. Especially in recent years, golf has become a sport that is watched and played by many different types of people, including children and adults. As a result of its popularity there has been an increased interest in, and in the production of golf equipment and various golf accessories. As golf has become more popular, sporting goods manufacturers have attempted to provide a wide variety of golf clubs, golf apparel such as shoes, golf bags and other items. Some companies have also provided golfers with devices that improve the golfer's playing ability. These items vary from those that improve the way a golfer swings a golf club to those that promise to improve the accuracy of a golf ball that is hit.

While certain items have proven to be useful and do in fact live up to their improvement goals, many items have not been effective. One of the most difficult elements of playing golf is the golfer's ability to accurately line up and sight a golf ball's trajectory along a golf course before hitting the ball. The angle at which the ball is struck, especially when putting is important, and improvements such as golf clubs with specialized head angles have proven to be effective at addressing this aspect. Unfortunately, the ball strike angle is only part of the problem. A golfer must also be able to visually determine the trajectory that the ball will travel after it is struck. There have been attempts to utilize laser-sighting devices to determine a golf ball's trajectory, but these devices are often complicated and expensive. Additionally, many golfers feel a laser-sighting device detracts from the game of golf by providing an unfair technological advantage.

The instant invention provides a simple-to-use, accurate and non-obtrusive means for determining a golf ball's trajectory prior to hitting the ball.

A search of the prior art did not disclose literature or patents that read directly on the claims of the instant invention. However, the following U.S. patents are considered related.

| PAT. NO. | INVENTOR | ISSUED |
|---|---|---|
| 6,721,962 | Plaire | 20 Apr. 2004 |
| 4,896,375 | Colucci | 30 Jan. 1990 |
| 4,063,740 | Mader | 20 Dec. 1977 |
| 3,812,593 | Wydro | 28 May 1974 |

The U.S. Pat. No. 6,721,962 discloses a lighted hat that provides illumination for the user while maintaining the appearance of a conventional cap visor. The lighted cap has a head-engaging portion, a brim attached to the front of the head-engaging portion and a headband that is connected to the lower inside rim of the head-engaging portion. A low profile light is incorporated into, and concealed within the brim of the hat.

The U.S. Pat. No. 4,896,375 discloses a golf cap having a headband and an elongated visor. The visor includes at least one marker that is plainly visible to the wearer. The visor is longer than a typical golf cap visor, and is sufficiently long so that the lower edge is below eye level when the wearer has positioned the hat on their head. The marker is in the form of a longitudinally extending line along the centerline of the visor. The golfer wearing the hat views the golf ball so that the longitudinal line is aligned with the ball and perpendicular to the proposed line of flight.

The U.S. Pat. No. 4,063,740 discloses a device that includes a flat piece of material having bent-over tabs along the top edge thereof. An aperture is formed in the material directly below each tab and a clip member is fitted through each of the apertures to attach the tabs to the brim of a golf cap or golf visor. A viewing aperture is formed in the material and spaced substantially equally from the side edges thereof. The aperture is located below the top edge of the cap or visor that corresponds approximately to the eye level of a golfer. The device provides the golfer with a peephole to the ball that is helpful in training a golfer to keep an eye on the ball throughout a swing.

The U.S. Pat. No. 3,812,593 discloses a golfer's green reader made up of an elastic headband, a visor attached to the headband and a spirit level attached to the front of the visor. On the lower side thereof, the level is disposed adjacent the front of the visor so that the user can view the level and thereby estimate the topography of the terrain of a golf green.

For background purposes and as indicative of the art to which the invention relates, reference may be made to the following remaining patents found in the search.

| PAT. NO. | INVENTOR | ISSUED |
|---|---|---|
| 6,672,972 | Stone | 6 Jan. 2004 |
| 3,826,502 | Sorge | 30 Jul. 1974 |
| 3,729,199 | Granberg | 24 Apr. 1973 |
| 3,437,339 | Starck | 8 Apr. 1969 |
| 3,178,187 | Cardwell | 13 Apr. 1965 |
| 3,156,211 | Mallory, Jr. | 10 Nov. 1964 |
| 1,459,705 | Bullock | 19 Jun. 1923 |

DISCLOSURE OF THE INVENTION

The removable golf-ball aligning device (RGAD) is designed to aid a golfer, especially when putting, to align a golf ball in a straight trajectory. The RGAD is further designed to be used in combination with a golf head gear that includes a front-facing bill having a downward-facing radiused front edge, an upper surface, a lower surface, a right edge and a left edge.

The RGAD in its basic design configuration is comprised of

A. A bill attachment member having a radius that substantially conforms to the radius of the bill's front edge. The member includes a right upper facing spring-clip and a left upper facing spring-clip. The two clips are designed to frictionally grasp the respective right and left edges of the bill.

B. A panel having a darkened lower section that terminates with a straight lower edge and a radiused upper edge that substantially conforms to the radiused front edge of the bill attachment member.

C. Means for attaching the radiused upper edge of the panel to the radiused front edge of the bill attachment member.

In view of the above disclosure the primary object of the invention is to provide an RGAD that is designed to be attached to the bill of a golf cap or golf visor. The RGAD aids a golfer, especially when putting, to produce a straight ball trajectory.

In addition to the primary object of the invention it is also an object of the invention to provide an RGAD that:

can be made in various colors, can include indicia, such as advertising indicia, can be worn as a regular sun-blocking cap or visor, can significantly improve a golfer's score, can be given away as a promotional item, and is cost effective from both a manufacturer's and consumer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
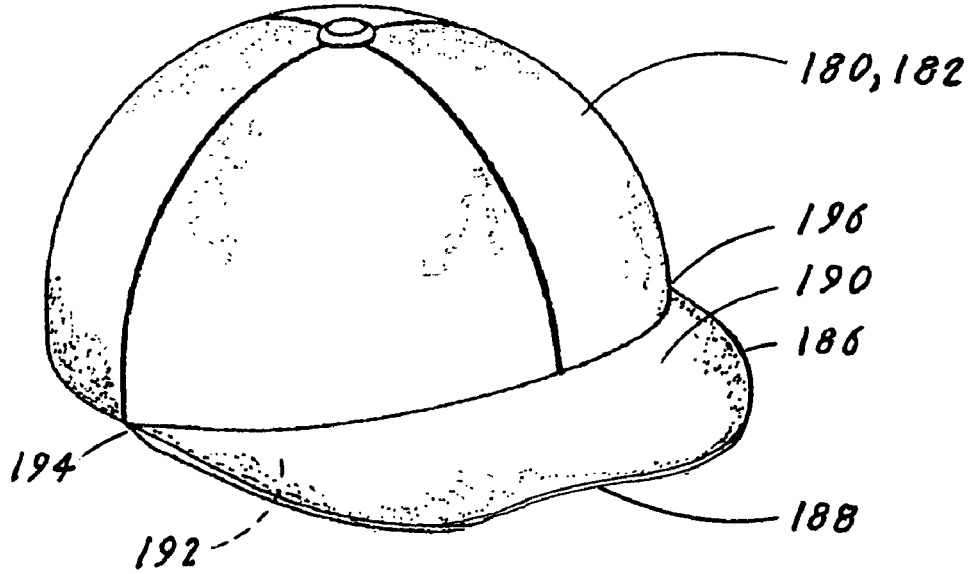
PRIOR ART Fig. 1
FIG. 1 is a perspective view of a prior art golf cap.
Figure 2:
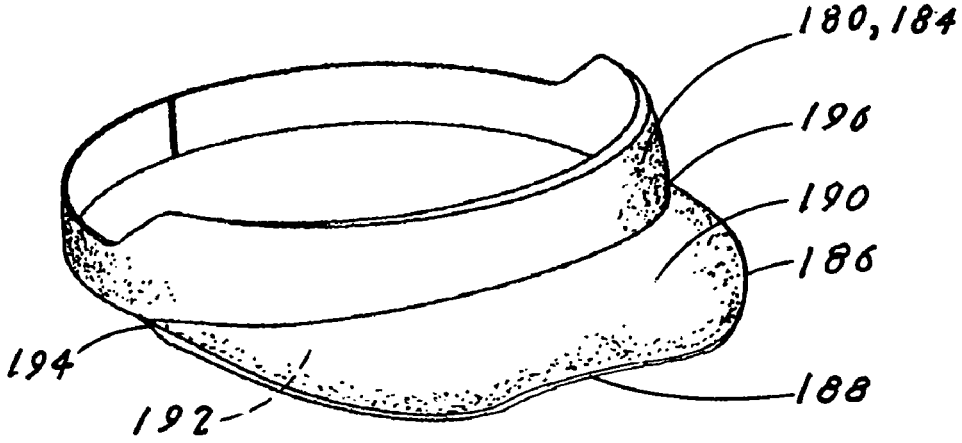
PRIOR ART Fig. 2
FIG. 2 is a perspective view of a prior art golf visor.

The best mode for carrying out the invention is presented in terms that disclose a preferred embodiment for a removable golf-ball aligning device (RGAD 10). The RGAD 10 is designed to be used in combination with a prior art golf head gear 180 that includes a golf cap 182, as shown in FIG. 1, or a golf visor 184, as shown in FIG. 2. Both the cap 182 and the visor 184 have a bill 186 that includes a downward-radiused front edge 188, an upper surface 190, a lower surface 192, a right edge 194, and a left edge 196, as also shown in FIGS. 1 and 2.

The preferred embodiment of the RGAD 10, as shown in FIGS. 3-12, is comprised of the following three major elements: a bill attachment member 12, a panel 30 and at least one means 46 for attaching the panel to the bill attachment member 12.

Figure 3:
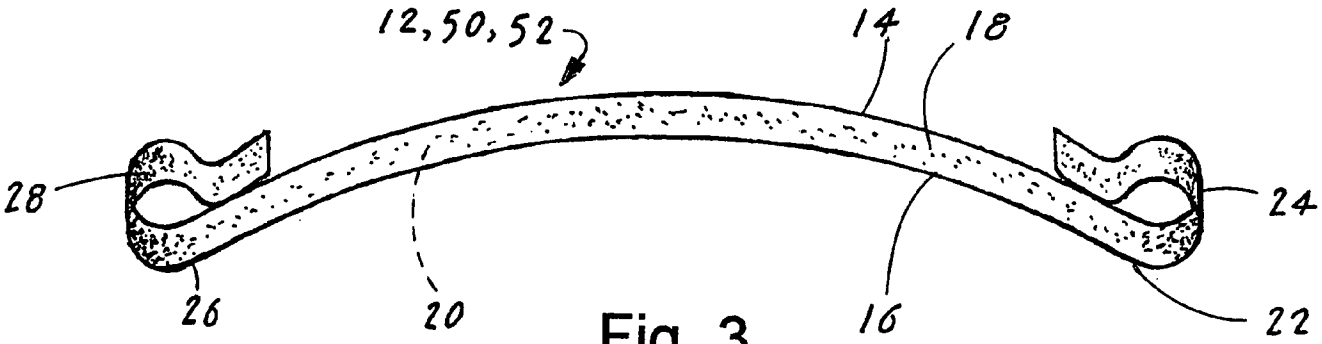
FIG. 3 is a perspective view of a bill attachment member.
Figure 5:
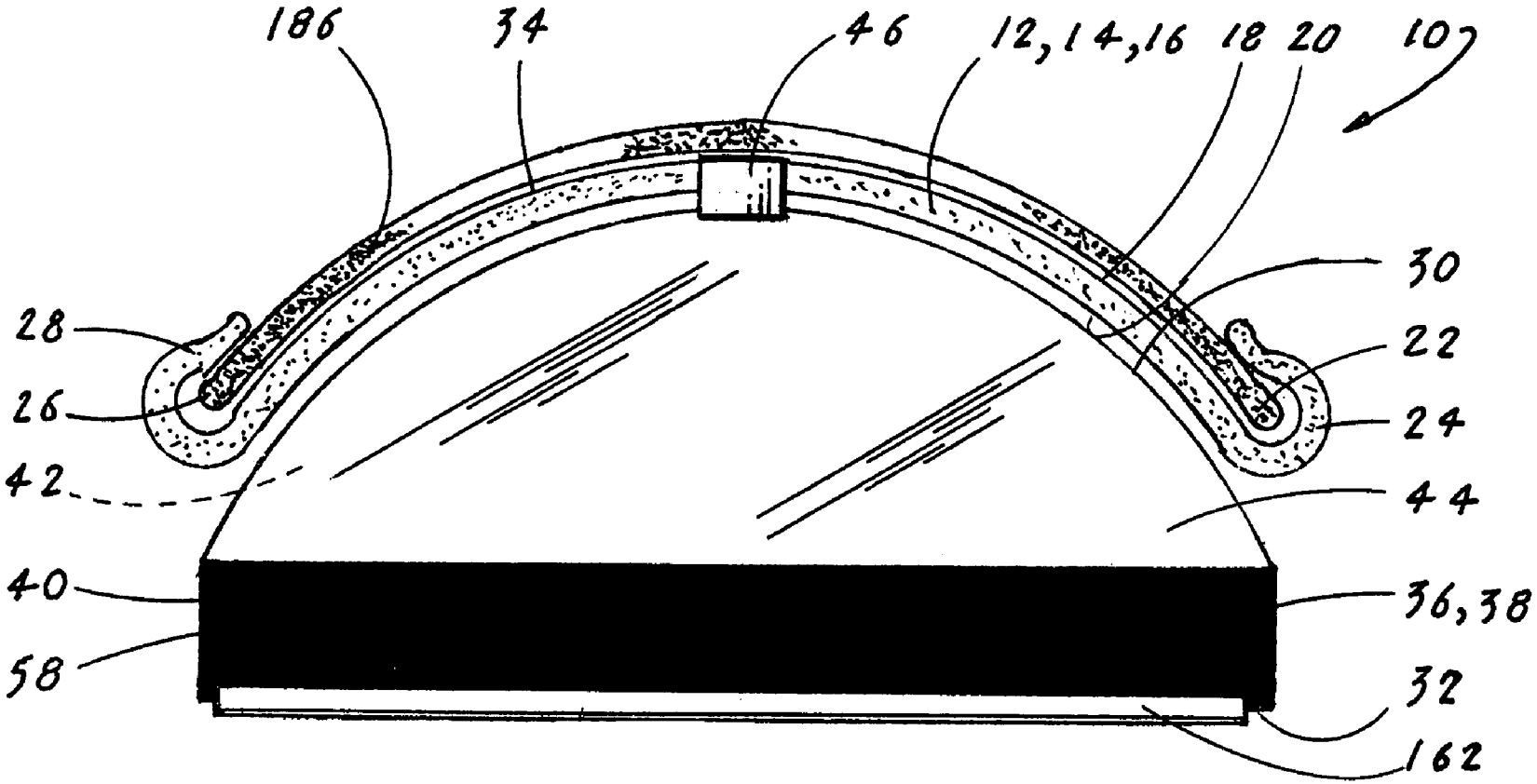
FIG. 5 is a front elevational view of a fully assembled RGAD showing the bill attachment member attached to the bill of a golf cap by a pair of spring clips, a panel attached to the bill attachment member by an attachment structure and an optional rigid tube attached to the lower straight edge of the panel.

The bill attachment member 12, as shown separated in FIG. 3 and assembled in FIG. 5, is made of a material 50 such as plastic 52 or a metal 54 such as spring-steel, which can be positioned to substantially conform to the bills 186 downward-radiused front edge 188. The width of the bill attachment member 12 can range from 0.125 to 0.75-inches (0.318 to 1.91 cm) with a width of 0.375-inches (0.953 cm) preferred.

The bill attachment member 12 has in addition to the downward-facing radiused front edge 14 and rear edge 16, an upper surface 18, lower surface 20, a right edge 22 and a left edge 26. As shown in FIGS. 3 and 5, the right edge 22 integrally terminates with a right upper facing spring clip 24. Likewise, the left edge 26 integrally terminates with a left upper facing spring-clip 28. Both of the spring clips 24,28 are designed to frictionally grasp the bills 186 respective right edge 194 and the left edge 196, as shown in FIG. 5.

Figure 4:
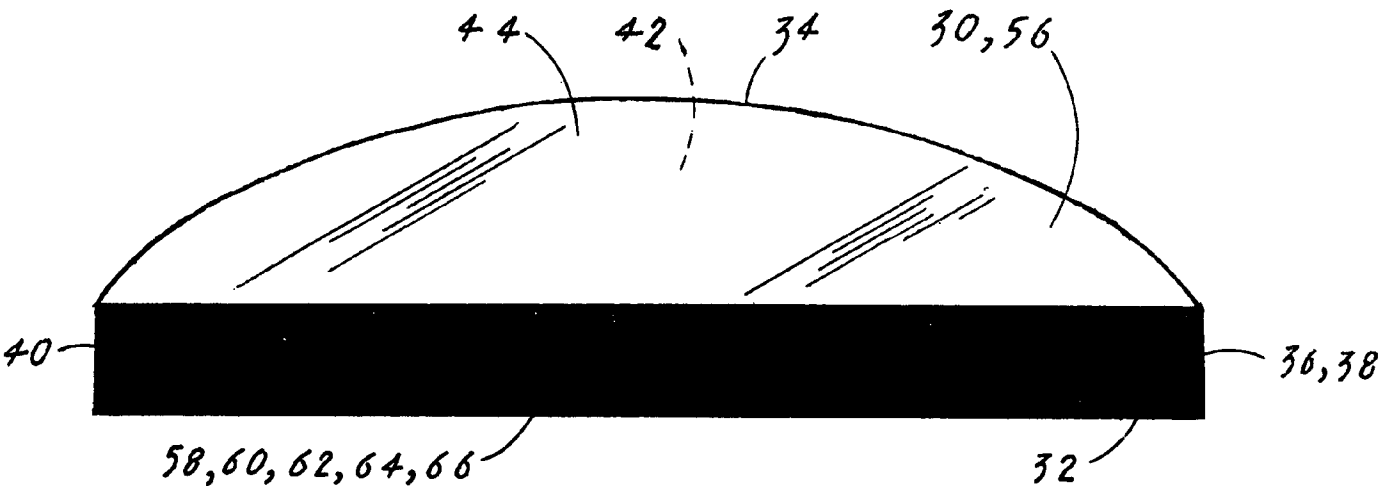
FIG. 4 is a front elevational view of a panel having a lower section that has a dark non-glare finish.

The panel 30, as shown separated in FIG. 4 and assembled in FIG. 5, has a lower straight edge 32, a radiused upper edge 34, a lower section 36, a truncated right edge 38, a truncated left edge 40, a front surface 42 and a rear surface 44.

The lower straight edge 32 is utilized by a golfer to sight a straight golf path trajectory especially when the golfer is putting. The radiused upper edge 34 substantially conforms to the radiused front edge 14 of the bill attachment member 12, as shown in FIG. 5.

The lower section 36, as also shown in FIGS. 4 and 5, has a truncated right edge 38 and a truncated left edge 40. The truncated right edge 38 terminates adjacent to the right spring clip 24 and the truncated left edge 40 terminates adjacent to the left spring clip 28.

Preferably, the panel 30 is made of a transparent material 56 with the lower section 36 having a dark non-glare finish 58. The non-glare finish 58 is achieved by an applied coating 60 such as a black non-glare paint 62. Alternatively the non-glare finish 58 can be provided by a black non-glare tape 64. The tape 64 can be applied by an adhesive 66 to either the front surface 42 or the rear surface 44 of the panel's 30 lower section 36.

Figure 6:
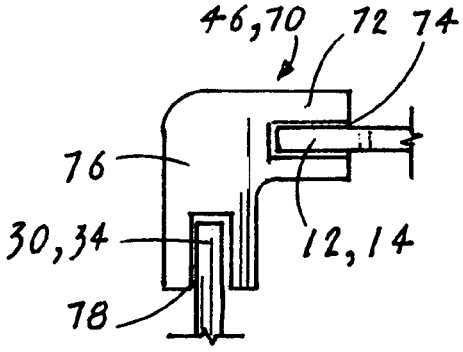
FIG. 6 is a side elevational view of a first design of a structure that attaches the panel to the bill attachment member.

The final element that comprises the RGAD 10 is the at least one means 46 for attaching the radiused upper edge 34 of the panel 30 to the radiused front edge 14 of the bill attachment member 12. Four attachment means 46 are disclosed: the first attachment means 46, as shown in FIG. 6, is comprised of a structure 70 that has a horizontal member 72 having a slot 74 that is dimensioned to frictionally receive and retain the radiused front edge 14 of the bill attachment member 12, and a vertical member 76 having a slot 78 that is dimensioned to frictionally receive and retain the radiused upper edge 34 of the panel 30.

Figure 7:
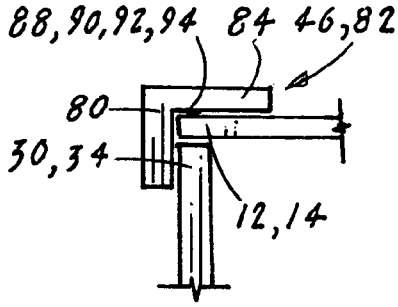
FIG. 7 is a side elevational view of a second design for a structure that attaches the panel to the bill attachment member.

The second attachment means 46, as shown in FIG. 7, is comprised of an inverted L-bracket 82 having a horizontal section 84 that is attached to the radiused front edge 14 of the bill attachment member 12, and a vertical section 86 that is attached to the radiused upper edge 34 of the panel 30. The horizontal and vertical sections 84,86 are attached by an L-bracket attachment means 88 that is selected from the group consisting of an adhesive 90, a pair of male and female detents 92 or a set of hook and loop fasteners 94.

Figure 8:
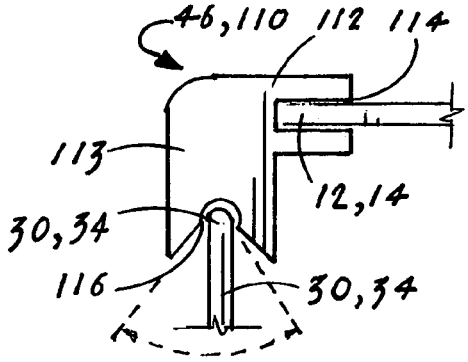
FIG. 8 is a side elevational view of a third design for a structure that attaches the panel to the bill attachment member.

The third attachment means 46, as shown in FIG. 8, is comprised of a structure 110 that includes an upper section 112 and a lower section 113. The upper section 112 has a side slot 114 that is dimensioned to frictionally receive and retain the radiused front edge 14 of the bill attachment member 12. The lower section 113 has a lower beveled slot 116 that is dimensioned to frictionally receive and retain the radiused upper edge 34 of the panel 30. The structure 110 allows the panel 30 to be rotated through a golfer-selectable angle.

Figure 9:
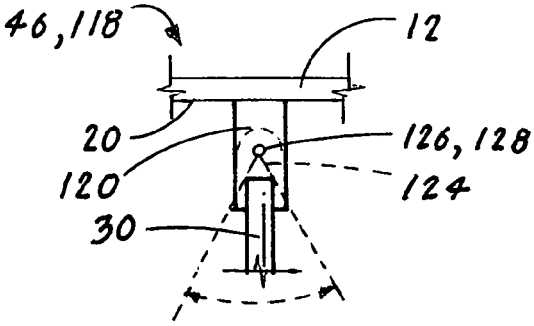
FIG. 9 is a side elevational view of a fourth design for a structure that attaches the panel to the bill attachment member.
Figure 10:
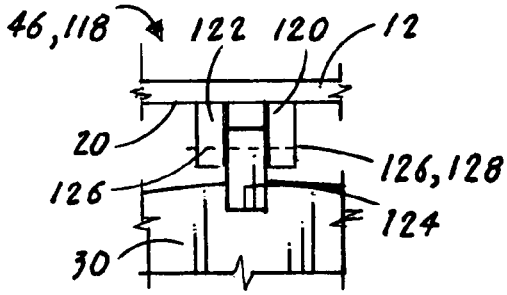
FIG. 10 is a rear elevational view of the structure shown in FIG. 9.

The fourth and final attachment means 46, as shown in FIGS. 9 and 10, is comprised of a bifurcated structure 118 that is comprised of right fork 120, a left fork 122, a central tab 124 and a retaining pin 128.

The right and left forks 120,122 integrally extend centrally from the lower surface 20 of said bill attachment member 12 with each fork having a pin bore 126 therethrough. The central tab 124 is attached to the radiused upper edge 34 of the panel 30 and also has a pin bore 126 that is in alignment with the pin bore 126 located on the right and left forks 120,122.

The retaining pin 128 is inserted sequentially into the right fork 120, the central tab 124 and into the left fork 122 and is attached thereto. The central tab 124 is dimensioned to allow the panel 30 to be rotated about the retaining pin 128 through golfer-selectable angle, as shown in FIG. 9. Additionally, in an alternate design, (not shown), the right and left forks 120,122 can be attached to the radiused upper edge 34 of the panel 30 and the central tab 124 can be attached to the lower surface 20 of the bill attachment member 12.

Figure 11:
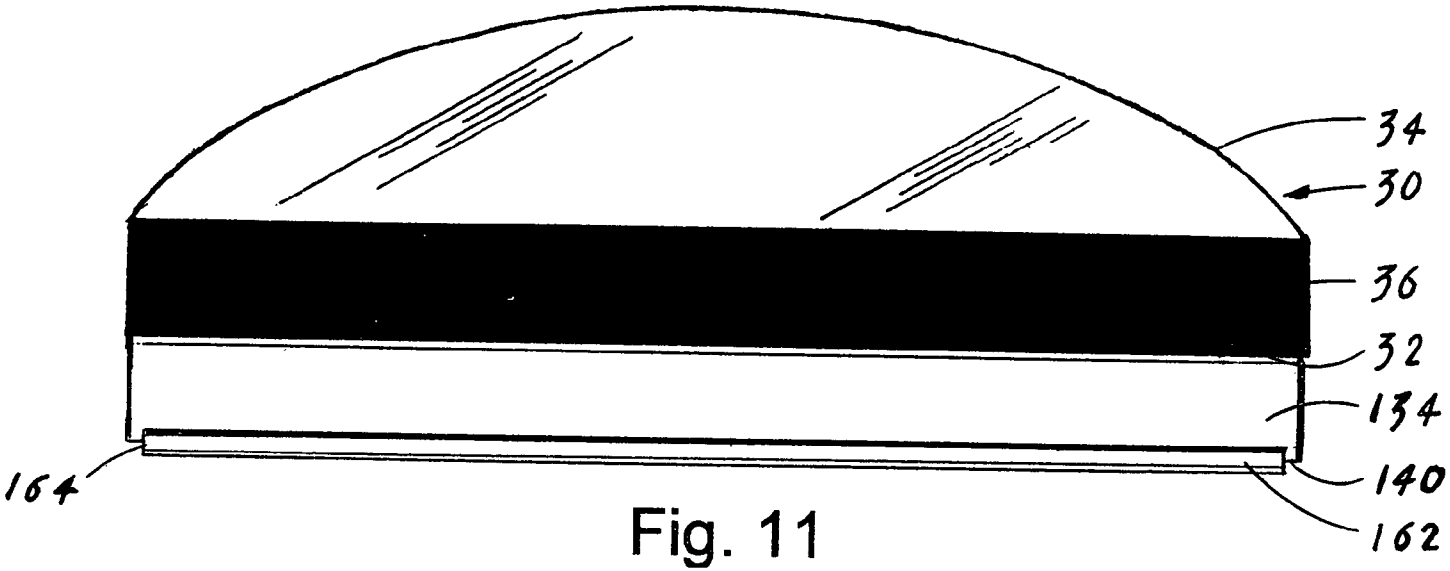
FIG. 11 is a front elevational view of a panel having an elongated tab attached to the panel's lower straight edge.
Figure 12:
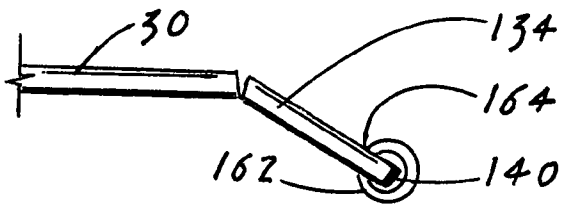
FIG. 12 is a side elevational view showing an elongated tab attached by means of a living hinge to the lower straight edge of the panel.

To augment the utility of the invention, the RGAD 10 can be designed to include an elongated movable tab 134. The tab 134, as shown in FIGS. 11 and 12, has an upper surface 136, a lower surface 138, a straight front edge 140, a rear edge 142, a right edge 144 and a left edge 146. The rear edge 142 of the tab 134 is movably attached to the lower straight edge 32 of the panel 30 by a tab attachment means 148 that preferably consists of a living hinge 150.

The upper surface 136 or the lower surface 138 of the elongated tab 134, as shown in FIG. 12, has a dark non-glare coating 152 that is selected from the group consisting of a black non-glare paint 154 and a black non-glare tape 156. The tape 156 can be attached by an adhesive 158 to either the upper surface 136 or the lower surface 138 of the tab 134. The tab 134 is designed to be adjusted vertically to further aid a golfer in aligning a golf ball to travel in a straight trajectory especially when putting.

To further enhance the utility of the invention, the RGAD 10 can be further comprised of a removably attached rigid tube 162. The tube 162 has a split edge 164 that allows the tube 162 to be inserted and retained over the lower straight edge 32 of the panel 30, as shown in FIG. 5, or over the straight front edge 140 of the movable tab 134, as shown in FIGS. 11 and 12. The tube 162 aids in maintaining the panel 30 and the tab 134 in a rigid straight configuration.

While the invention has been described in detail and pictorially shown in the accompanying drawings it is not to be limited to such details, since many changes and modifications may be made to the invention without departing from the spirit and the scope thereof. Hence, it is described to cover any and all modifications and forms which may come within the language and scope of the claims.

The invention claimed is:

1. A removable golf-ball aligning device (RGAD) that functions in combination with a golf head gear that includes a front-facing bill having a downward-facing radiused front edge, an upper surface, a lower surface, a right edge and a left edge, said RGAD comprising:

a) a bill attachment member made of spring steel and having a downward-facing radiused front edge and rear edge, wherein the radius substantially conforms to the radius of the bill's front edge, an upper surface, a lower surface, a right edge that integrally terminates with a right upper-facing spring-clip and a left edge that integrally terminates with a left upper-facing spring-clip, wherein the clips are designed to frictionally grasp the respective right and left edges of the bill, b) a panel having a lower straight edge, a radiused upper edge that substantially conforms to the radiused front edge of said bill attachment member, a lower darkened section having a straight edge, a truncated right edge that terminates adjacent to the right spring clip, a truncated left edge that terminates adjacent to the left spring clip, a front surface and a rear surface, c) a structure for attaching the radiused upper edge of said panel to the radiused front edge of said bill attachment member comprising:

(1) a horizontal member having a slot that is dimensioned to frictionally receive and retain the radiused front edge of said bill attachment member, and (2) a vertical member having a slot that is dimensioned to frictionally receive and retain the radiused upper edge of said panel.

2. The RGAD as specified in claim 1 wherein said structure for attaching the radiused upper edge of said panel to the radiused front edge of said bill attachment member comprises an inverted L-bracket having:

a) a horizontal section that is attached to the radiused front edge of said bill attachment member, and b) a vertical section that is attached to the radiused upper edge of said panel, wherein the horizontal and vertical sections are attached by an L-bracket attachment means.

3. The RGAD as specified in claim 2 wherein said L-bracket attachment means is selected from the group consisting of an adhesive, a pair of male and female detents and a set of hook and loop fasteners.

4. The RGAD as specified in claim 1 wherein said means for attaching the radiused upper edge of said panel to the front edge of said bill attachment member comprises a bifurcated structure having:

a) a right fork and a left fork that integrally extends from the central lower surface of said bill attachment member, with the right and left forks each having a pin bore therethrough, b) a central tab that is attached to the radiused upper edge of said panel, with said tab having a pin bore that is in alignment with the pin bores located on the right and left forks, and c) a retaining pin that is inserted sequentially into the right fork, the central tab and into the left fork, wherein the central tab is dimensioned to allow said panel to be rotated through a golfer-selectable angle.

5. The RGAD as specified in claim 1 further comprising an elongated movable tab having an upper surface, a lower surface, a straight front edge, a rear edge, a right edge and a left edge, wherein the rear edge of said tab is movably attached to the lower straight edge of said panel by a tab attachment means, wherein said movable tab can be adjusted vertically to further aid a golfer in aligning the golf ball to travel in a straight trajectory along a golf course.

6. The RGAD as specified in claim 5 wherein said tab attachment means for attaching the rear edge of said movable tab to the straight front edge of said tab comprises a living hinge.

7. The RGAD as specified in claim 5 wherein the lower surface of said movable tab has a dark non-glare coating that is selected from the group consisting of a black non-glare paint and a black non-glare tape that is attached by an adhesive to either the upper surface or the lower surface of said tab.

8. The RGAD as specified in claim 5 further comprising a removably-attached rigid tube having a split edge that allows the tube to be inserted and retained over the straight front edge of said elongated movable tab, wherein said tube aids in maintaining said tab in a rigid straight configuration.

9. The RGAD as specified in claim 1 further comprising a removably-attached rigid tube having a split edge that allows the tube to be inserted and retained over the lower straight edge of said panel, wherein said tube aids in maintaining said panel in a rigid straight configuration.

10. A removable golf-ball aligning device (RGAD) that functions in combination with a golf head gear that includes a front facing bill having a downward-facing radiused front edge, an upper surface, a lower surface, a right edge and a left edge, said RGAD comprising:

a) a bill attachment member having a radius that substantially conforms to the radius of the bill's front edge, said member having a right upper-facing spring-clip and a left upper-facing spring clip, wherein the two clips are designed to frictionally grasp the respective right and left edges of the bill, b) a panel having a darkened lower section that terminates with a straight edge that extends from the bill's right edge to the left edge, and a radiused upper edge that substantially conforms to the radiused front edge of said bill attachment member, and c) a structure for attaching the radiused upper edge of said panel to the front edge of said bill attachment member, said structure comprising:

(1) an upper section having a side slot that is dimensioned to frictionally receive and retain the radiused front edge of said bill, and (2) a lower section having a lower beveled slot that is dimensioned to frictionally receive and retain the radiused upper edge of said panel, wherein said structure allows said panel to be rotated through a golfer-selectable angle.

* * * * *